United States Patent [19]

Fry et al.

[11] 4,350,081

[45] Sep. 21, 1982

[54] FAIL-SAFE DEVICE FOR ACTUATORS

[75] Inventors: Jeremy J. Fry; Christopher Warnett, both of Bath, England

[73] Assignee: Rotork Controls Limited, Bath, England

[21] Appl. No.: 169,454

[22] Filed: Jul. 16, 1980

[30] Foreign Application Priority Data

Jul. 20, 1979 [GB] United Kingdom ..... 7925443

[51] Int. Cl.[3] ..... F01B 29/00; F01B 21/00

[52] U.S. Cl. ..... 92/128; 92/130 C

[58] Field of Search ..... 92/130 R, 130 D, 130 C, 92/128, 138, 94, 95; 251/58, 62

[56] References Cited

U.S. PATENT DOCUMENTS

| | | | |
|---|---|---|---|
| 742,290 | 10/1903 | Clark | 92/130 C |
| 3,727,523 | 4/1973 | Gulick | 92/130 C |
| 3,824,901 | 7/1974 | Shofer | 92/130 C |

*Primary Examiner*—Paul E. Maslousky

*Attorney, Agent, or Firm*—Stevens, Davis, Miller & Mosher

[57] ABSTRACT

A piston-cylinder type actuator is provided with a fail-safe unit for returning the piston 10 to a fail-safe position in the event of failure of the power supply to the cylinder 12. The fail-safe device comprises a housing unit 27 which is detachably connected to the casing 18 of the actuator. The housing contains a pre-loaded spring 30 acting between the closed end 29 of the housing and a movable cap member 31 which is engaged by the piston rod 17. The cap member is retained in the housing by a fixed ring 32 which is connected to a flange 38 of the actuator. Removal of the fail-safe unit is prevented unless the piston is in its fail-safe position by means of a bayonet-type fitting comprising lugs 35 on the housing which are axially and rotatably engaged with locking recesses on the remote surface of the adaptor flange 38.

8 Claims, 5 Drawing Figures

FAIL-SAFE DEVICE FOR ACTUATORS

This invention relates to actuators and in particular to actuators of the kind incorporating a piston-cylinder unit, the piston being movable in response to fluid pressure to operate an output member for actuating an associated mechanism such as a valve.

The invention is concerned with actuators of the kind referred to above in which the piston is preferably double-acting and is associated with a fail-safe device for moving the piston to a predetermined end position of its stroke in the event of power failure.

Hithertofore, such actuators have utilized a spring return to provide for fail-safe operation and in known designs of such actuators it has been possible to dismantle the spring assembly while the spring is in a compressed condition and acting on the piston rod. The conditions present a serious harard to an operator attempting to disassemble the actuator as the spring can fly off causing serious injury as the last fastener is removed.

It is an object therefore of the present invention to provide an improved spring return fail-safe arrangement for an actuator which avoids this disadvantage and which will prevent the removal of the spring assembly should the spring be under compression.

In its broadest aspect the invention provides a fail-safe mechanism for an actuator, the mechanism including a detachable unit comprising a housing containing a pre-loaded spring device which is operatively connected with the piston rod of the actuator when the unit is fitted thereto.

In the preferred embodiment the fail-safe unit is attachable to the actuator by a connection which prevents removal of the unit when the spring is still under compression. Preferably the connection is a fitting of the bayonet-type, the unit being provided with lugs for engaging axially corresponding slots in a mounting adaptor on the actuator. The subsequent rotational movement of the unit to its operative position on the actuator then enables the connection of the unit to the actuator and the transfer of the spring pre-load force to the piston rod. De-mounting of the unit from the actuator is prevented when the spring is still under compression in that the release of the connecting means transfers the spring force to the housing of the unit when then forces the lugs of the unit into recesses in the mounting adaptor so as to prevent reverse rotation of the unit to its inoperative position.

The fail-safe attachment of the invention is a self-contained unit in which the pre-loaded spring is permanently housed.

The preferred embodiment of the invention will now be described in detail by way of example with reference to the accompanying drawings, in which.

Figure 1:
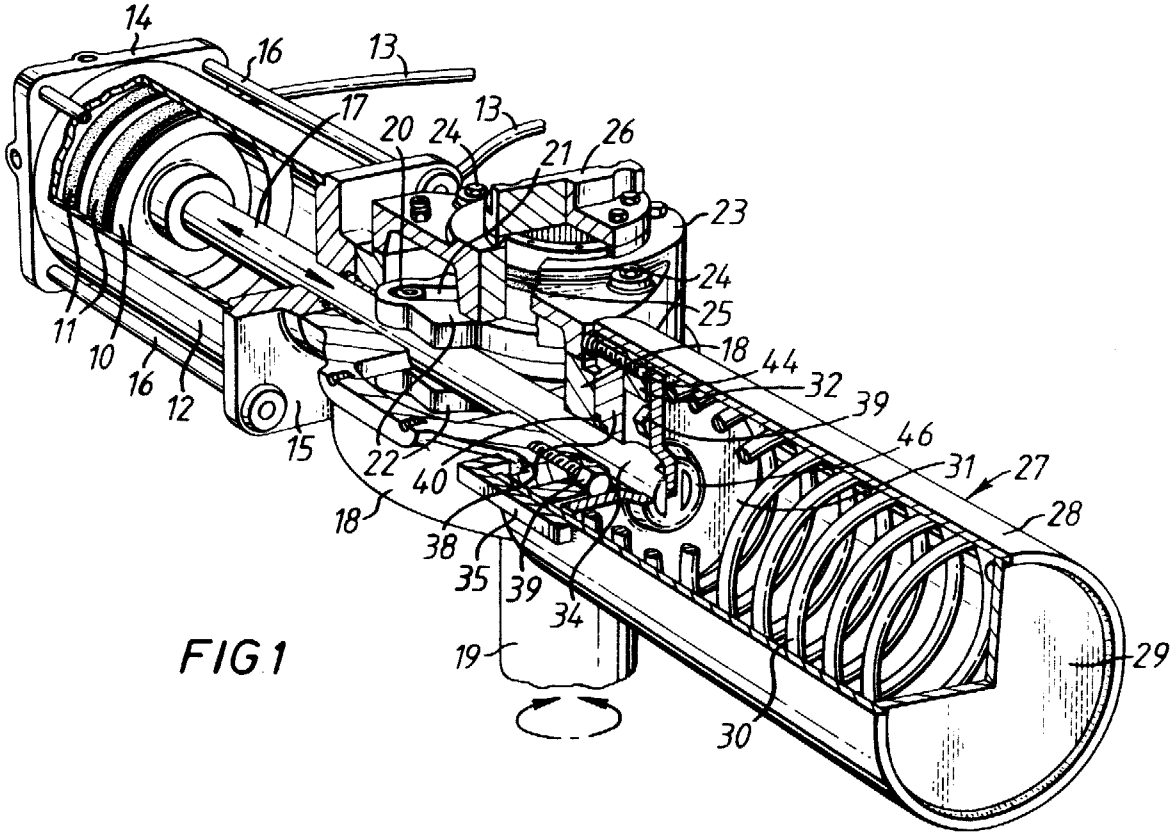
FIG. 1 is a perspective view partly in section of an actuator incorporating the fail-safe device of the invention.

Referring now to FIG. 1 of the drawings, the actuator shown therein is of the kind comprising a double acting piston-cylinder unit, the piston 10 having the usual peripheral seals 11 and being slidable in the cylinder 12 in response to fluid pressure applied to one or other side of the piston 10 and which may be pneumatic or hydraulic pressure. Pipelines 13 are shown to indicate possible connections from the ends of the cylinder 12 with a source of pressure and exhaust for controlling the operation of the actuator.

The cylinder 12 is sealingly supported at its ends between flange plates 14 and 15, which plates are interconnected by tie rods 16 which are designed to stretch in the event of an abnormally high pressure so as to relieve the pressure through the end sealing gaskets.

The piston rod 17 extends through the end flange plate 15 into an intermediate housing 18 which contains and supports the output shaft 19 of the actuator. The output shaft 19 is conveniently mounted transversely to the piston rod 17 and it may accept various valve shafts or other shafts requiring actuation.

The axial movement of the piston rod 17 is transmitted to the output shaft 19 by a pin and slot connection. As shown a transverse pin 20 is carried by the piston rod 17 and projects on opposite sides of the rod into elongated slots 21 formed in a pair of arms 22 fixedly attached to the shaft 19. The arrangement is such that during axial movement of the piston rod 17 in one or other direction the pin 20 is able to move along the slots 21 while rotating arms 22 which thereby produces a corresponding angular movement of the output shaft 19. The angular movement of the shaft 19 so produced depends on the shape of the slots 21, which are shown in the drawings as straight slots extending radially from the shaft 19, but which may be varied in shape, for example, curved to produce a predetermined angular output movement.

The upper end of the shaft 19 is located in a cover plate 23 for the housing 18 and which is attached by long retaining bolts 24 which are also adapted to stretch so as to relieve abnormal pressure in the housing through the sealing gaskets. The shaft 19 is provided with a double sealing ring 25 and at its upper end a position indicator 26 is attached, which may also be adapted to operate limit switches and other accessories.

The end of the piston rod 17 extends through the housing 18 and is adapted to project into a self-contained unit 27 when attached to the housing 18 of the actuator casing and which contains a spring for providing a fail-safe operation of the actuator to return the piston 10 to a safe end position in the event of power failure. In FIG. 1 the safe end position for the piston is the position shown in which the piston is at the end of the cylinder 12 adjacent the end flange plate 14.

Figure 2:
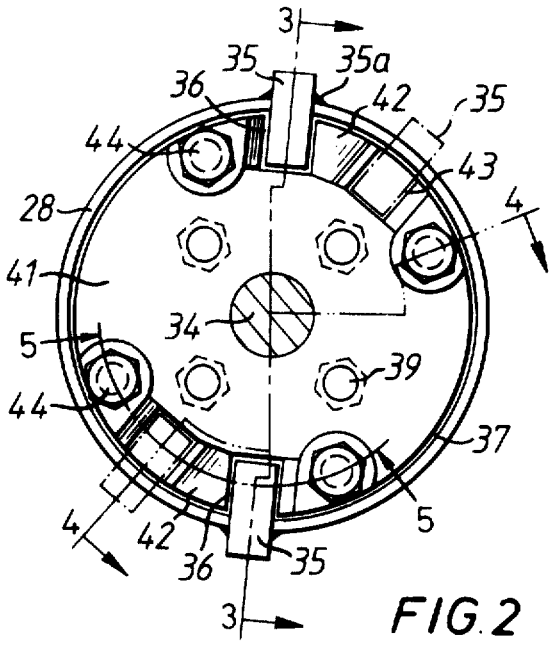
FIG. 2 is an end view of the fail-safe device showing the connecting flange of the actuator casing but omitting for clarity the connecting part of the actuator casing body.
Figure 3:
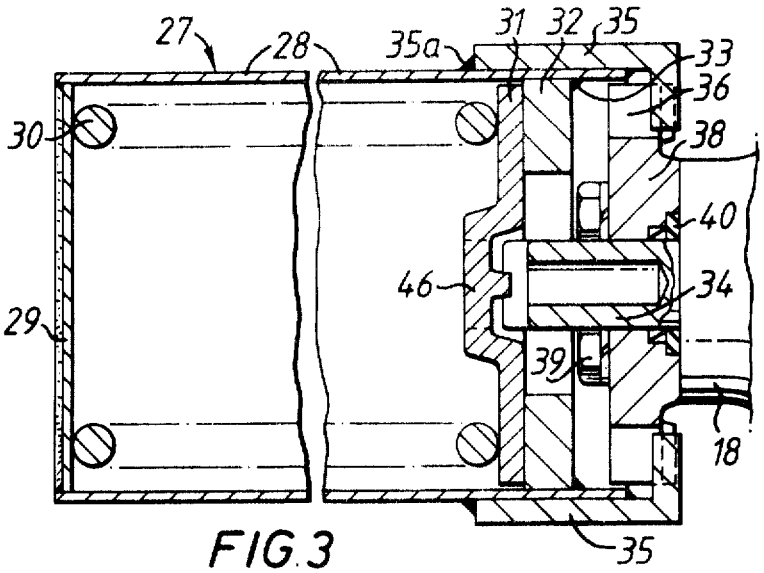
FIG. 3 is a section on the line 3—3 of FIG. 2 showing the fail-safe device in its loose and unbolted position on the connecting flange of the actuator casing.
Figure 4:
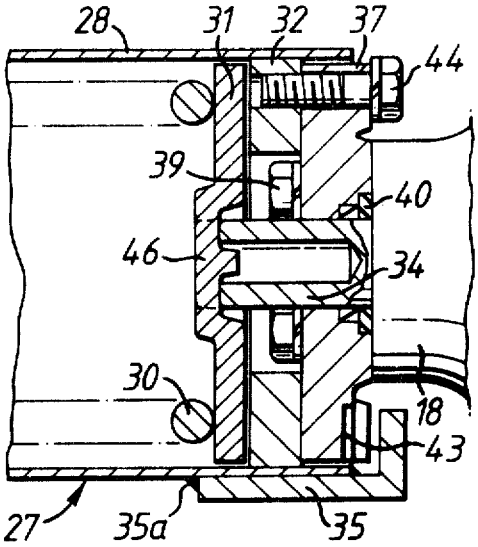
FIG. 4 is a part-section on the line 4—4 of FIG. 2 showing the fail-safe device bolted in its working position on the connecting flange of the actuator casing.

Referring now also to FIGS. 2 to 4 of the drawings, the fail-safe unit 27 comprises a housing in the form of a steel tube 28 which is closed at one end 29 and which contains a coiled compression spring 30. The spring 30 is pre-loaded and is located in the tube 28 between the closed end 29 and a movable cap plate 31 which is retained in the tube 28 by a steel ring 32 welded as at 33 to the inside of the tube adjacent its other open end. The cap plate 31 is thereby urged against the steel ring 32 by the pre-loaded spring 30 and the arrangement is such that when the fail-safe unit 27 is attached to the actuator the end 34 of the piston rod 17 extends through the ring into engagement with the cap plate 31 as will be hereinafter described.

The open end of the tube 28 is attached to the actuator by a bayonet-type connection and to this end the tube is provided with lugs 35 welded as at 35*a* to the outside of the tube and which project axially with their end portions extending radially inwardly of the mouth of the tube (see FIG. 3). The radially inwardly projecting portions of the lugs 35 are adapted to slide axially through corresponding slots 36 formed in the periphery of the flange 37 of a mounting adaptor 38 secured to the housing 18 of the actuator by bolts 39. The end 34 of the piston rod 17 projects through the mounting adaptor 38 which is provided with suitable seals 40 (see FIG. 3).

Figure 5:
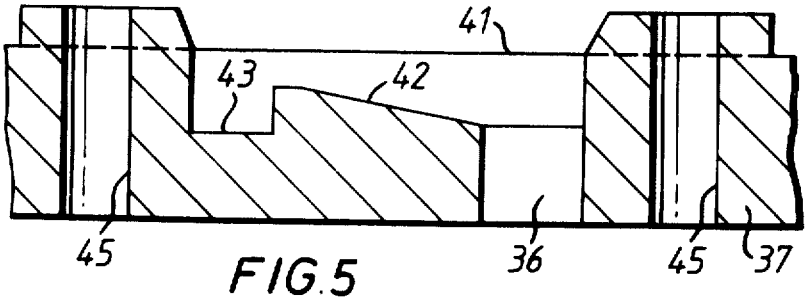
FIG. 5 is a part-section on the line 5—5 of FIG. 2 showing details of the profile of the inner face of the connecting flange of the actuator.

The mounting of the fail-safe unit 27 is completed by a rotation of the tube 28 relative to the mounting adaptor 38 through a predetermined angle, for example 35°, so as to bring the unit to its operative or working position. The loose or unlocked position of the lugs 35 of the tube 28 is shown in full lines in FIG. 2. As the tube 28 is rotated to its working position the lugs 35 each move angularly to new positions on the remote face 41 of the adaptor flange 37 along a circumferential surface 42 which is inclined in an axial direction at an angle, for example 10° (see FIG. 5). The inclined surfaces 42 ensure that the tube 28 is drawn axially towards the adaptor flange 37 during its rotational movement to its operative position and the surfaces furthermore allow for the provision of end recesses 43. In the working position of the tube 28 the lugs 35 are now located opposite the recesses 43 and the lugs 35 move into and engage the recesses 43 under the slight force exerted by the spring 30 in the tube 28 of the fail-safe unit 27. The working or operative position of the lugs 35 is shown in FIG. 2 by chain lines.

The tube 28 of the fail-safe unit 27 is attached positively to the mounting adaptor 38 of the housing 18 of the actuator by a plurality of bolts 44 (see FIG. 4) which are inserted in bolt holes 45 in the remote face 41 of the adaptor flange 37 and which threadedly engage the steel ring 32 welded inside the tube 28 of the fail-safe unit. When the unit is in the working position as described above the mounting holes 45 are correctly aligned with the threaded holes in the steel ring 32 and as the bolts 44 are tightened they pull the steel rings 32 and thereby the tube 28 towards the mounting adaptor 38 until the steel ring 32 is brought into engagement with the adaptor 38 as shown in FIG. 4. As the bolts 44 tighten the open end of the tube 28 slides over the outer edge of the adaptor flange 37 and this movement of the tube 28 enables the cap plate 31 to move into engagement with the end 34 of the piston rod 17 as shown in FIG. 4, the central part of the plate 31 being shaped as at 46 so as to engage into and around the end 34 of the rod. The force of the spring 30 is thereby transferred directly to the end 34 of the piston rod 17 when the fail-safe unit is attached by the bolts 44 to the actuator. During operation of the actuator the spring 30 is compressed in the tube 28 as the piston 10 moves to its other end position in the cylinder 12. In the event of power failure the spring 30 acts to move the piston 10 to its fail-safe end position in the actuator as shown in FIG. 1.

In order to detach the fail-safe unit 27, the mounting bolts 44 are first removed. If the piston 10 is at its end position remote from the spring as shown in FIG. 1, the spring 30 will not be under any undue compression and the tube 28 can therefore be rotated and is then free to be removed by an axial sliding movement of the lugs 35 through the corresponding slots 36 in the flange 37 of the mounting adaptor 38. If however the spring 30 is still under compression when the mounting bolts 44 are removed the tube 28 will be urged away from the mounting adaptor 38 by the spring 30 and the lugs 35 will be engaged positively in the recesses 43 in the adaptor flange 37. The force exerted by the spring 30 will thereby act to prevent the disengagement of the lugs 35 from the recesses 43 and this will prevent any rotation of the tube 28 which hence cannot be removed until the piston 10 has returned to its safe end position and the spring is no longer under compression.

Although the invention is generally concerned with actuators which are fluid pressure operated, in the preferred embodiment the actuator incorporates a piston cylinder unit which is pneumatically operated.

The arrangement as described above thereby provides a self-contained fail-safe spring unit which can be attached to and dismantled from an actuator without risk of damage by the spring as removal is prevented until the spring force has been substantially removed. The arrangement also provides a completely self-contained fail-safe unit which can be fitted to or removed from an actuator depending on whether a fail-safe facility is required.

We claim:

1. An actuator comprising a piston and cylinder unit and means for flowing fluid under pressure into the cylinder to actuate the piston, a casing attached to said unit, an output member mounted in the casing, said piston having a piston rod attached thereto which extends through said casing and is operatively connected with said output member for actuating said output member in response to movement of said piston in said cylinder, and a fail-safe unit for returning said piston to a fail-safe position in said cylinder in the event of failure of the power supply to said cylinder, said fail-safe unit comprising a housing closed at one end and an opposite open end, a movable cap member disposed in said opposite end, a preloaded compression spring disposed in said housing between said closed end, and said movable cap member, a fixed ring member secured within said housing adjacent said opposite open end retaining the movable cap member in said housing, said piston rod extending through said ring member whereby an end thereof engages said cap member when said housing is fitted to the actuator casing, said actuator being characterized in that the fail-safe unit is detachably connected to said actuator casing by an attachment means which prevents disconnection of said fail-safe unit until said piston has been moved by said spring to its fail-safe position in said cylinder.

2. An actuator as claimed in claim 1, wherein said casing comprises an adaptor flange, and said attachment means comprises a bayonet-type fitting in which a plurality of projections on said fail-safe unit slidably and rotatably engage said adaptor flange.

3. An actuator as claimed in claim 2, wherein said tubular housing has a plurality of radially inwardly projecting lugs fixed thereto at its open end, said adaptor flange having axial slots therein, said lugs slidably engaging corresponding axial slots, and said housing being rotatable relative to said flange to engage said lugs on the remote surface of said flange.

4. An actuator as claimed in claim 3, wherein said remote surface of the flange has locking recesses therein and said housing is rotatable relative to said flange to position said lugs each opposite a locking recess.

5. An actuator as claimed in claim 4 having securing means for connecting said flange to the fixed ring member of said fail-safe unit when said housing is rotatably positioned to locate said lugs opposite said locking recesses.

6. An actuator as claimed in claim 5, wherein each axial slot is formed in the periphery of said adaptor flange, and wherein each slot is connected with a corresponding locking recess by an inclined surface.

7. An actuator as claimed in claim 1, 2, 3, 4, 5 or 6 wherein the cap member is formed with a recess for receiving said end of the piston rod of said actuator.

8. An actuator as claimed in claim 7, wherein the adaptor flange is connected to said casing and said piston rod extends slidably through said adaptor flange and fixed ring to engage said cap member to compress said spring as said piston moves away from its fail-safe position in said cylinder.

* * * * *